US010184706B2

(12) United States Patent
Kil et al.

(10) Patent No.: US 10,184,706 B2
(45) Date of Patent: Jan. 22, 2019

(54) AIR CONDITIONER

(71) Applicant: SAMSUNG ELECTRONICS CO., LTD., Suwon-si (KR)

(72) Inventors: Yong-hyun Kil, Suwon-si (KR); Jung-ho Kim, Suwon-si (KR); Hyun-woo Park, Suwon-si (KR); Kyung-hoon Kim, Suwon-si (KR); Kwang-ho Choi, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 423 days.

(21) Appl. No.: 14/850,429

(22) Filed: Sep. 10, 2015

(65) Prior Publication Data

US 2016/0123640 A1 May 5, 2016

(30) Foreign Application Priority Data

Oct. 29, 2014 (KR) ..... 10-2014-0148141

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01); *F25B 2400/075* (2013.01); *F25B 2400/077* (2013.01); *F25B 2400/13* (2013.01); *F25B 2500/13* (2013.01); *F25B 2500/18* (2013.01); *F25B 2500/31* (2013.01); *F25B 2600/0261* (2013.01); *F25B 2600/25* (2013.01); *F25B 2700/1931* (2013.01); *F25B 2700/1933* (2013.01)

(58) Field of Classification Search
CPC ..... F25B 13/00; F25B 2400/075; F25B 2400/077; F25B 2400/13; F25B 2500/13; F25B 2500/18; F25B 2500/31; F25B 2600/0261; F25B 2600/25; F25B 2700/1931; F25B 2700/1933; F25B 49/02
USPC ..... 62/299
See application file for complete search history.

(56) References Cited

U.S. PATENT DOCUMENTS 3,721,475 A * 3/1973 Kawase et al. ..... B60T 8/171 188/181 A
5,996,369 A * 12/1999 Hirota ..... B60H 1/00878 137/597
7,162,884 B2 * 1/2007 Alles ..... F24F 3/0442 137/597
7,591,145 B1 9/2009 Wiggs
(Continued)

FOREIGN PATENT DOCUMENTS

EP 2 578 965 4/2013

*Primary Examiner* — Filip Zec
(74) *Attorney, Agent, or Firm* — Staas & Halsey LLP

(57) ABSTRACT

An air conditioner is provided. The air conditioner, which comprises a compressor, an outdoor heat exchanger, an indoor heat exchanger, a four-way valve, an accumulator, and an oil separator, and cools or heats a room by circulating a refrigerant. The air conditioner comprises a first block which is disposed on a first channel of the refrigerant between the oil separator and the four-way valve, and the first block is modular and includes a plurality of first control parts, and a second block which is disposed on a second channel of the refrigerant between the outdoor heat exchanger and the indoor heat exchanger, and the second block is modular and includes a plurality of second control parts.

15 Claims, 9 Drawing Sheets

(56) References Cited

U.S. PATENT DOCUMENTS

| | | | | |
|---|---|---|---|---|
| 8,869,549 | B2 * | 10/2014 | Morimoto | F24F 3/06<br>62/324.6 |
| 2008/0006266 | A1 * | 1/2008 | Bolam | A61K 49/1815<br>128/200.24 |
| 2008/0053121 | A1 | 3/2008 | Park et al. | |

* cited by examiner

AIR CONDITIONER

CROSS-REFERENCE TO RELATED APPLICATIONS

This application claims the benefit under 35 U.S.C. § 119(a) of a Korean patent application filed on Oct. 29, 2014 in the Korean Intellectual Property Office and assigned Serial No. 10-2014-0148141, the entire disclosure of which is hereby incorporated by reference.

BACKGROUND

1. Field

Apparatuses and methods consistent with exemplary embodiments relate to an air conditioner, and more particularly, to an air conditioner provided with a modularized block.

2. Description of the Related Art

Air conditioners are devices for cooling or heating a room by circulating a refrigerant between an indoor unit and an outdoor unit. In order to cool or heat, a refrigeration cycle is typically applied.

The outdoor unit of such an air conditioner includes a plurality of parts, such as a compressor, an oil separator, an accumulator, a four-way valve, an expansion valve, a check valve, a solenoid valve, etc., and these parts are connected with one another by means of a pipe. In this case, each of the parts receives a vibration of the compressor from the pipe directly or indirectly and thus vibrates. Therefore, the parts have their respective natural frequencies, and, if the parts have the same natural frequency, there is a problem that the pipe is broken due to a resonance phenomenon.

A related-art method for preventing a pipe from being broken by minimizing such a resonance phenomenon is elongating the pipe connecting each part and configuring the pipe complexly. In addition, a welding operation is required to connect the pipe and the parts and a working space for the welding operation is required. Therefore, there is a problem that the size of the outdoor unit increases.

Therefore, there is a limit to the size of the usable compressor due to an unnecessary space occupied by the pipe in the outdoor unit, and thus there is a limit to cooling and heating efficiency.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments provide an air conditioner which has inner parts of an outdoor unit modularized, thereby preventing a pipe from being broken by a resonance phenomenon occurring in the outdoor unit.

One or more exemplary embodiments also provide an air conditioner which can omit a pipe by modularizing inner parts of an outdoor unit, guarantee an inner space of the outdoor unit, and thus reduce the size of the outdoor unit, or can improve performance using a large-size compressor in the guaranteed space.

According to an aspect of an exemplary embodiment, there is provided an air conditioner which includes a compressor, an oil separator, a four-way valve, an outdoor heat exchanger, an indoor heat exchanger, and an accumulator, and the air conditioner cools or heats a room by circulating a refrigerant. The air conditioner may include a first block which is disposed on a first channel of the refrigerant between the oil separator and the four-way valve, and the first block is modular and includes a plurality of first control parts, and a second block which is disposed on a second channel of the refrigerant between the outdoor heat exchanger and the indoor heat exchanger, and the second block is modular and includes a plurality of second control parts.

The first block may include a first housing having a part of the plurality of first control parts fixed outside the first housing, and having other parts of the plurality of first control parts fixed disposed inside the first housing.

The first housing may have a plurality of first communication parts protruding outside to communicate with the plurality of first control parts, and a part of the plurality of first control parts may be fixed to a part of the plurality of first communication parts by welding.

The plurality of first control parts nay include at least one of a first check valve, a first solenoid valve, a high-pressure switch, and a high-pressure sensor.

The second block may include a second housing having a part of the plurality of second control parts fixed outside the second housing, and having other parts disposed inside the second housing.

The second housing may have a plurality of second communication parts protruding outside the second housing to communicate with the plurality of second control parts, and a part of the plurality of second control parts may be fixed to a part of the plurality of second communication parts by welding.

The plurality of second control parts may include at least one of a second check valve, a filter, a subcooler, a sub-expansion valve, a second solenoid valve, a third solenoid valve, and an outdoor expansion valve.

The air conditioner may further include a third block which is disposed on a third channel of the refrigerant between the accumulator and the compressor, the third block being modular and having a plurality of third control parts.

The third block may include a third housing having the plurality of third control parts fixed outside.

The third housing may have a plurality of third communication parts protruding outside the third housing to communicate with the plurality of third control parts, and the plurality of third control parts may be fixed to the plurality of third communication parts by welding.

The plurality of third control parts may include at least one of a low-pressure sensor and a fourth solenoid valve.

The compressor may be provided in plural number, plural oil separators may be provided to correspond with plural compressors, and the oil separator and the accumulator may be fixed to each other and move in one body.

The oil separator may be fixed to the accumulator by a bracket to be at a distance from the accumulator.

According to an aspect of another exemplary embodiment, there is provided an air conditioner which includes a compressor, an oil separator, a four-way valve, an outdoor heat exchanger, an indoor heat exchanger, and an accumulator, and cools or heats a room by circulating a refrigerant. The air conditioner includes a single block having a first refrigerant channel between the oil separator and the four-way valve, a second refrigerant channel between the outdoor heat exchanger and the indoor heat exchanger, and a third refrigerant channel between the accumulator and the compressor, wherein the block is modular and the block includes a plurality of control parts.

The block may include a housing, the housing may have a plurality of communication parts protruding to the outside to communicate with a part of the plurality of control parts, and a part of the plurality of control parts may be fixed to the communication parts by welding.

The other control parts may be disposed in the housing.

A refrigerant passing through the first refrigerant channel may have a higher temperature than that of a refrigerant passing through the second refrigerant channel, and the refrigerant passing through the second refrigerant channel may have a higher temperature than that of a refrigerant passing through the third refrigerant channel.

The compressor is provided in plural number, and plural oil separators may be provided to correspond with plural compressors, and the oil separators may be fixed at a distance from the accumulator.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
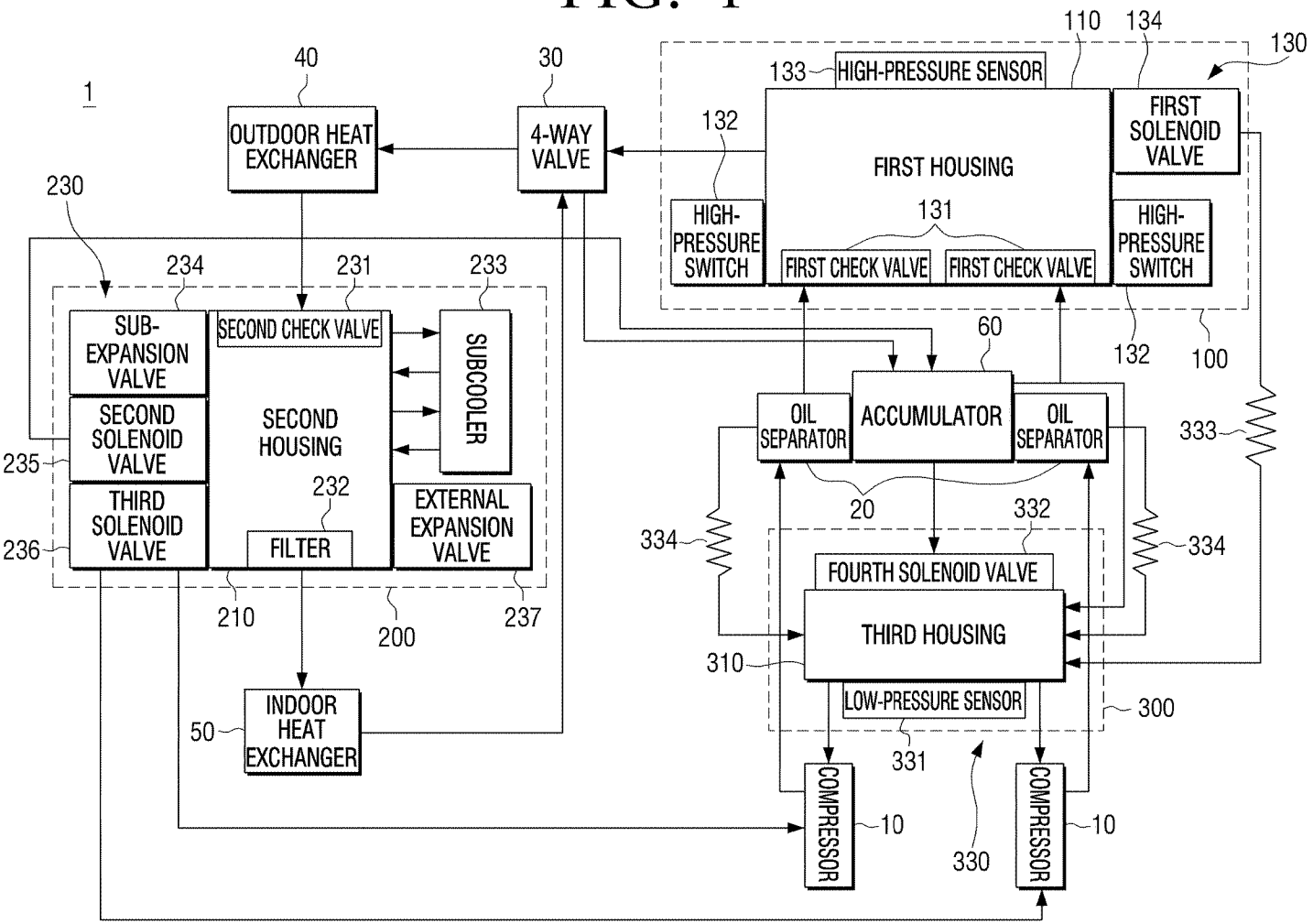
FIG. 1 is a block diagram showing an air conditioner according to an exemplary embodiment.

Reference will now be made in detail to the embodiments of the present invention, examples of which are illustrated in the accompanying drawings, wherein like reference numerals refer to like elements throughout.

Hereinafter, an air conditioner 1 according to exemplary embodiments will be described in greater detail with reference to the accompanying drawings. In the following description, well-known functions or constructions are not described in detail since they would obscure the invention in unnecessary detail. In addition, for the easy understanding of the present disclosure, the accompanying drawings are not illustrated according to a real scale, and the dimension of some elements may be illustrated exaggeratively.

Referring to FIG. 1, the air conditioner 1 according to an exemplary embodiment includes a compressor 10, an oil separator 20, a four-way valve 30, an outdoor heat exchanger 40, an indoor heat exchanger 50, an accumulator 60, and first to third blocks 100, 200, and 300. Herein, the flow direction of a refrigerant is illustrated by arrows, but this flow of the refrigerant is illustrated on the assumption that a cooling operation is performed. It is obvious to a person skilled in the art that, when the flow of the refrigerant is changed in the four-way valve 30, heating is possible. In addition, the outdoor unit of the air conditioner 1 includes only the compressor 10, the oil separator 20, the four-way valve 30, the outdoor heat exchanger 40, and the accumulator 60.

The compressor 10 receives the refrigerant in a low-pressure and low-temperature state from the accumulator 60, which will be described later, and compresses the refrigerant to be in a high-pressure and high-temperature state. The compressor 10 involves a strong vibration when being driven, and thus vibrates the other parts provided in the air conditioner 1 due to this vibration.

Although the air conditioner 1 which is provided with two compressors 10 like a typical large-size air conditioner is illustrated in the present exemplary embodiment, only a single compressor 10 may be provided when necessary or three or more compressors 10 may be provided. When a plurality of compressors 10 are provided, only some of the plurality of compressors 10 may be driven or all of the compressors 10 may be driven according to the degree of cooling and heating.

The oil separator 20 filters the oil included in the high-pressure and high-temperature refrigerant discharged from the compressor 10, and moves the refrigerant back to the compressor 10. The oil is used to facilitate the driving of the compressor 10. In addition, when a plurality of compressors 10 are provided, the same number of oil separators 20 as the compressors may be provided. Thus, in the present exemplary embodiment, two oil separators 20 are provided to correspond to the two compressors 10. The oil separator 20 and the compressor 10 are connected with each other via a pipe.

The four-way valve 30 receives the high-pressure and high-temperature refrigerant discharged from the oil separator 20, and adjusts the channel of the refrigerant so as to discharge the high-pressure and high-temperature refrigerant toward the outdoor heat exchanger 40 during a cooling operation, and discharge the high-pressure and high-temperature refrigerant toward the indoor heat exchanger 50 during a heating operation. The four-way valve 30 is connected with a pipe for discharging, toward the accumulator 50, the low-pressure and low-temperature refrigerant which has performed the cooling or heating operation and then has returned.

During the cooling operation, the outdoor heat exchanger 40 allows the high-pressure and high-temperature refrigerant flowing from the four-way valve 30 to pass therethrough, and discharges heat toward the outside. On the other hand, during the heating operation, the outdoor heat exchanger 40 allows the low-pressure and low-temperature refrigerant passing through the indoor heat exchanger 50 and an outdoor expansion valve 70, which will be described later, to flow thereinto and pass therethrough, and absorbs heat from the outside.

During the cooling operation, the indoor heat exchanger 50 allows the low-pressure and low-temperature refrigerant passing through the outdoor heat exchanger 40 and an indoor expansion valve (not shown) to flow thereinto and pass therethrough, and absorbs heat from the inside. On the hand, during the heating operation, the indoor heat exchanger 50 allows the high-pressure and high-temperature refrigerant flowing from the four-way valve 30 to pass therethrough and discharges heat toward the inside.

The accumulator 60 allows the low-pressure and low-temperature refrigerant passing through the outdoor heat exchanger 40 or the indoor heat exchanger 50 to flow thereinto through the four-way valve 30, and discharges the low-pressure and low-temperature refrigerant toward the compressor 10.

In this case, when the refrigerant flowing into the compressor 10 is mixed with a liquid refrigerant, the compressor 10 may suffer from a defect, and thus the refrigerant is divided into a liquid refrigerant and a gaseous refrigerant in the accumulator 60. Accordingly, the liquid refrigerant does not flow into the compressor 10 and only the gaseous refrigerant flows into the compressor 10. The capacity of the accumulator 60 is provided in proportion to the amount of refrigerant flowing in the air conditioner.

Since the compressor 10, the oil separator 20, the four-way valve 30, the outdoor heat exchanger 40, the indoor heat exchanger 50, and the accumulator 60 described above are well known, a detailed description thereof is omitted.

Figure 2:
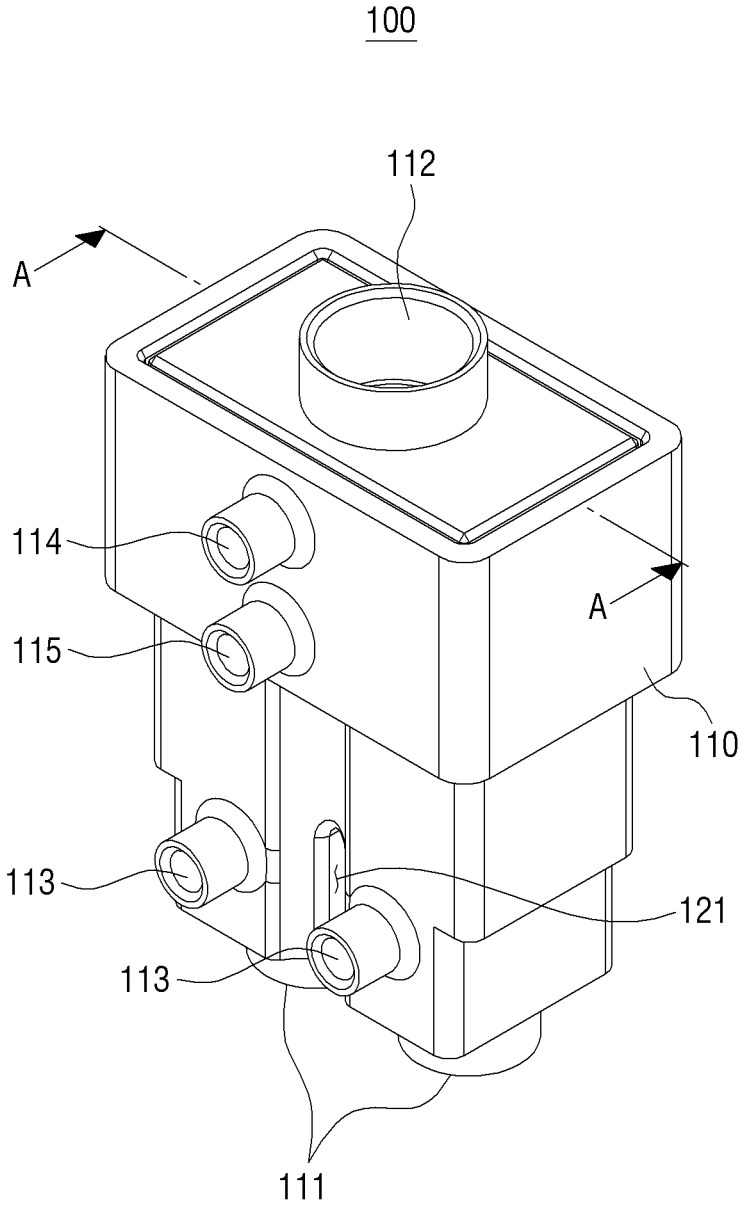
FIG. 2 is a perspective view showing a first block shown in FIG. 1.
Figure 3:
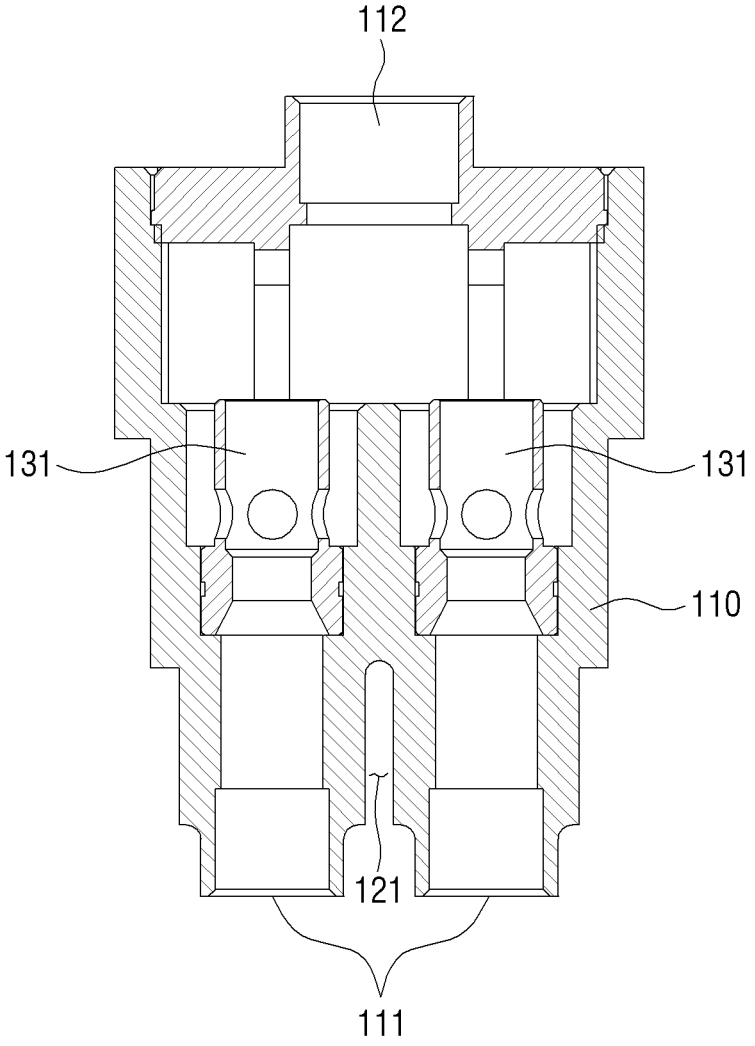
FIG. 3 is a cross section view taken along line A-A of FIG. 2.

Referring to FIGS. 2 and 3, a first block 100 is disposed on the channel of the refrigerant between the oil separator 20 and the four-way valve 30, and includes a first housing 110 and first control parts 130.

The first housing 110 includes a first inflow part 111, a first discharge part 112, and first communication parts 113, 114 and 115 (113-115).

The first inflow part 111 is a part through which the refrigerant discharged from the oil separator 20 flows in, and the first discharge part 112 is a part through which the flowing refrigerant is discharged toward the four-way valve 30. The oil separator 20 may be provided as many as the number of compressors 10, and thus, when a plurality of compressors 10 are provided, the first inflow part 111 may be provided in plural number. Accordingly, since the two compressors 10 and the two oil separators 20 are provided in the present exemplary embodiment, two first inflow parts 111 are provided.

The first control parts 130, which are disposed on the channel of the refrigerant between the oil separator 20 and the four-way valve 30, are connected and fixed to the first communication parts 113-115, and the first communication parts 113-115 include a high-pressure switch communication part 113, a high-pressure sensor communication part 114, and a first solenoid valve communication part 115. The first communication parts 113-115 will be explained along with the first control parts 130 connected thereto.

The first inflow part 111 and the first discharge part 112 may be connected to a pipe where the refrigerant flows by welding, and the first communication parts 113-115 may be connected with the first control parts 130 by welding. Since each part is securely fixed to the first housing 110 by welding, the first block 100 moves in one body.

In this case, the welding requires a high temperature and thus a damage and deformation may occur on parts except for the part requiring the welding. Therefore, the first inflow part 111, the first discharge part 112, and the first communication parts 113-115 protrude to the outside of the first housing 110, and an area contacting a high temperature may be minimized. In addition, an unnecessary part 121 except for the pipe where the refrigerant flows may be removed when the first housing 110 is manufactured, so that the part contacting the high temperature can be minimized.

The first control parts 130 include a first check valve 131, a high-pressure switch 132, a high-pressure sensor 133, and a first solenoid valve 134.

The first check valve 131 allows the high-pressure and high-temperature refrigerant flowing from the oil separator 20 to be discharged only toward the four-way valve 30, and prevents backflow in the opposite direction. The first check valve 131 is fixedly disposed on the channel connecting the first inflow part 111 and the first discharge part 112 inside the first housing 110.

When the pressure of the high-pressure and high-temperature refrigerant flowing from the oil separator 20 exceeds a predetermined pressure, the high-pressure switch 132 stops driving the air conditioner 1. Such a high-pressure switch 132 is fixedly connected to the high-pressure switch communication part 113.

The high-pressure sensor 133 measures the pressure of the high-pressure and high-temperature refrigerant flowing from the oil separator 20 and controls the driving of the compressor 10. Such a high-pressure sensor 133 is fixedly connected to the high-pressure sensor communication part 114.

When the compressor 10 is frozen by an external temperature, a problem may arise in the driving of the compressor 10. To prevent this, the first solenoid valve 134 is provided to selectively discharge the high-temperature refrigerant from the first block 100 to a third block 300, which will be described later. Such a first solenoid valve 134 is fixedly connected to the first solenoid valve communication part 115.

Since the first check valve 131, the high-pressure switch 132, the high-pressure sensor 133, and the first solenoid valve 134 described above are well known, a detailed description thereof is omitted.

Figure 4:
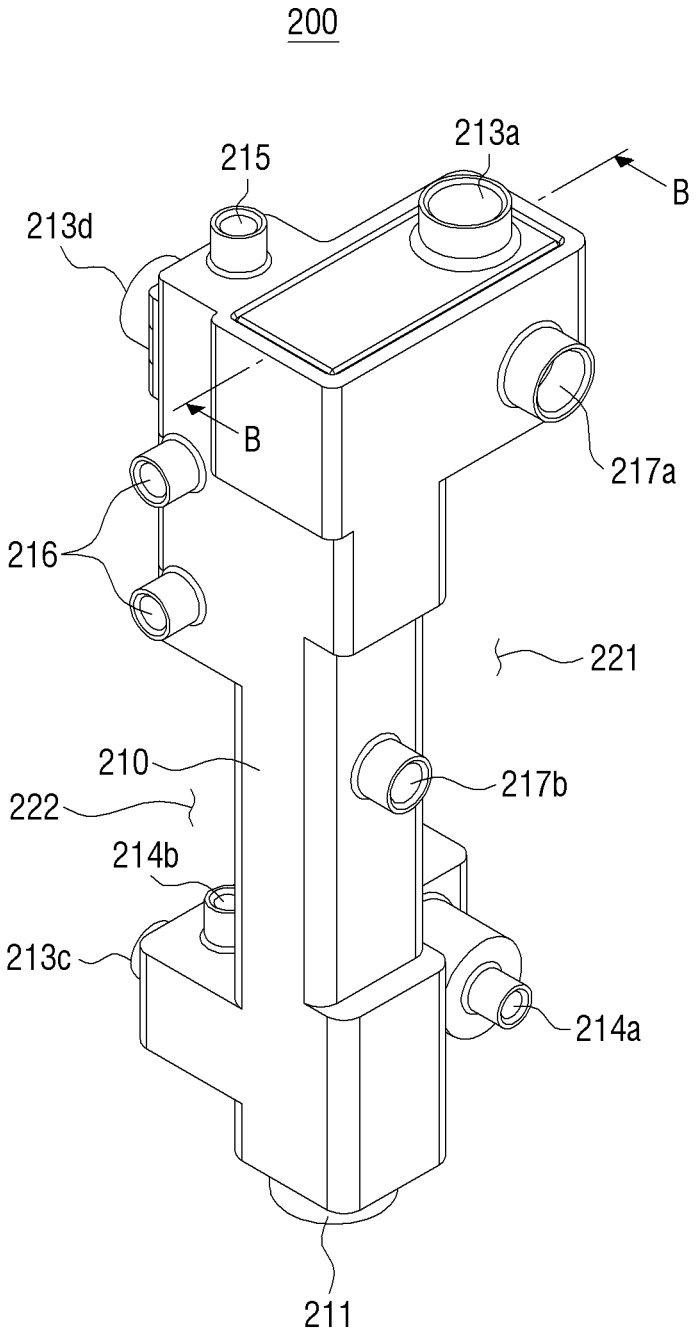
FIG. 4 is a perspective view showing a second block shown in FIG. 1.
Figure 5:
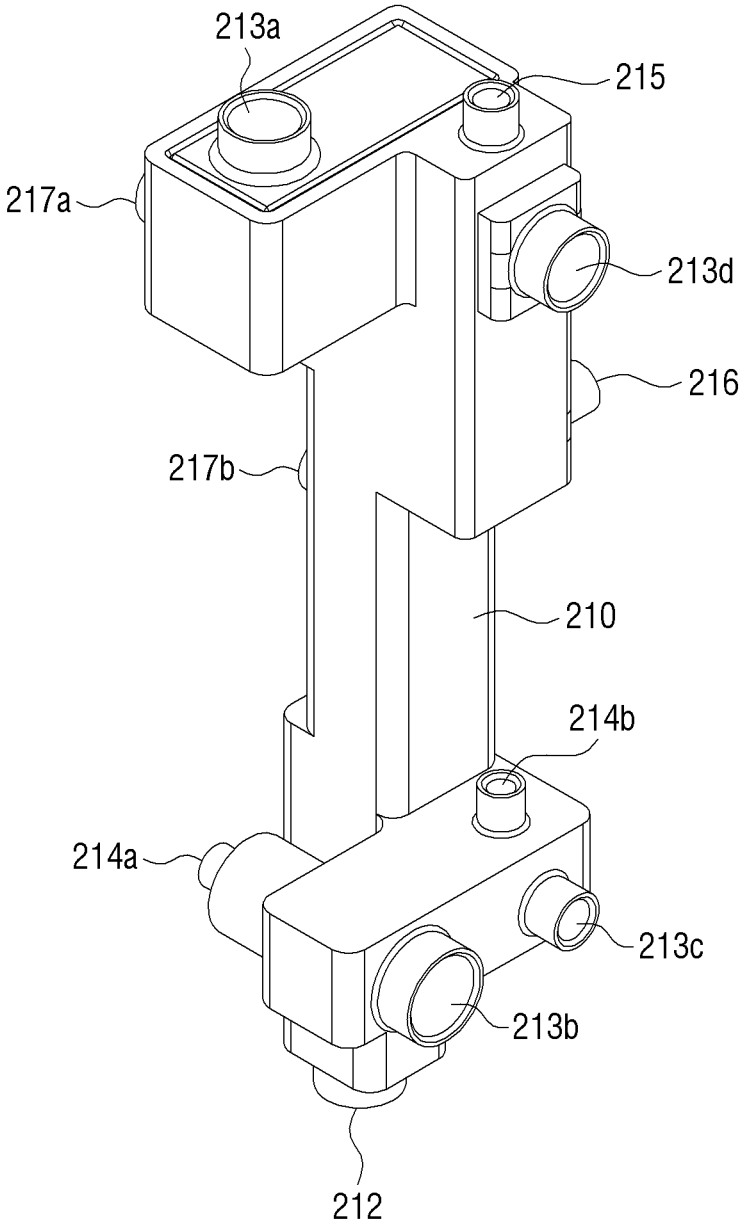
FIG. 5 is a perspective view showing the second block of FIG. 4, as viewed from the opposite direction.
Figure 6:
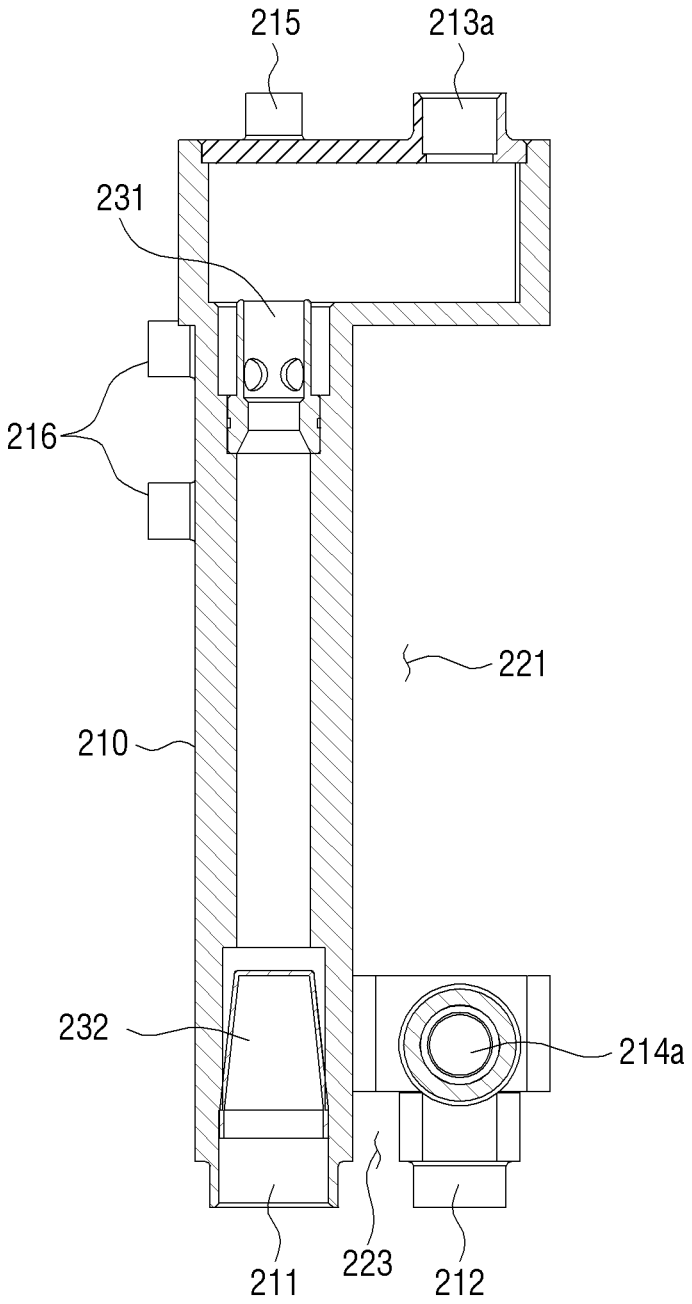
FIG. 6 is a cross section view taken along line B-B of FIG. 4.

Referring to FIGS. 4 to 6, a second block 200 is disposed on the channel of the refrigerant between the outdoor heat exchanger 40 and the indoor heat exchanger 50, and includes a second housing 210 and second control parts 230.

The second housing 210 includes a first inflow and outflow part 211, a second inflow and outflow part 212, and second communication parts 213*a-d*, 214*a-b*, 215, 216, 217*a-b* (213*a*-217*b*).

The first inflow and outflow part 211 is a part through which the refrigerant discharged from the outdoor heat exchanger 40 flows in during the cooling operation, and through which the refrigerant flowing from the indoor heat exchanger 50 is discharged toward the outdoor heat exchanger 40 during the heating operation.

The second inflow and outflow part 212 is a part through which the refrigerant flowing from the outdoor heat exchanger 40 is discharged toward the indoor heat exchanger 50 during the cooling operation, and through which the refrigerant discharged from the indoor heat exchanger 50 flows in during the heating operation.

The second control parts 230, which are disposed on the channel of the refrigerant between the outdoor heat exchanger 40 and the indoor heat exchanger 50, are connected and fixed to the second communication parts 213*a*-217*b*, and the second communication parts 213*a*-217*b* include subcooler communication parts 213*a*-213*d*, sub-expansion valve communication parts 214*a*, 214*b*, a second solenoid valve communication part 215, a third solenoid valve communication part 216, and external expansion valve communication parts 217*a*, 217*b*. The second communication parts 213*a*-217*b* will be explained along with the second control parts 230 connected thereto.

The first inflow and outflow part 211 and the second inflow and outflow part 212 may be connected to a pipe where the refrigerant flows by welding, and the second communication parts 213*a*-217*b* may be connected with the second control parts 230 by welding. Since each part is securely fixed to the second housing 210 by welding, the second block 200 moves in one body.

However, in order to prevent a damage and deformation from occurring on parts of the second housing 210 except for the part requiring the welding as in the case of the first block 100, the first inflow and outflow part 211, the second inflow and outflow part 212, and the second communication parts 213*a*-217*b* protrude to the outside of the second housing 210, and an area contacting a high temperature may be minimized. In addition, unnecessary parts 221-223 except for the pipe where the refrigerant flows may be removed from the second housing 210.

The second control parts 230 include a second check valve 231, a filter 232, a subcooler 233, a sub-expansion valve 234, a second solenoid valve 235, a third solenoid valve 236, and an external expansion valve 237.

The second check valve 231 allows the high-pressure refrigerant flowing from the outdoor heat exchanger 40 to be discharged only toward the indoor heat exchanger 50 during the cooling operation, and prevents backflow in the opposite direction. The second check valve 231 is fixedly disposed on the channel connecting the first inflow and outflow part 211 and the second inflow and outflow part 212 inside the second housing 210.

The filter 232 is fixedly disposed on the channel connecting the first inflow and outflow part 211 and the second inflow and outflow part 212 inside the second housing 210 in order to remove impurities from the refrigerant flowing from the outdoor heat exchanger 40 or the indoor heat exchanger 50.

The subcooler 233 increases the cooling efficiency by further reducing the temperature of the refrigerant. The subcooler 233 is fixedly connected to the subcooler communication parts 213*a*-213*d*.

In this case, the flow of the refrigerant during the cooling operation is as follows. First, the refrigerant flows into the subcooler 233 from the second housing 210 through a first subcooler communication part 213*a*.

Thereafter, the refrigerant is supercooled and then flows back to the second housing 210 through a second subcooler communication part 213*b*, and most of the refrigerant is discharged toward the indoor heat exchanger 50 through the second inflow and outflow part 212.

However, a small amount of refrigerant is discharged through a first sub-expansion valve communication part 214*a* and flows into the sub-expansion valve 234, and the refrigerant expanded in the sub-expansion valve 234 flows back to the second housing 210 through a second sub-expansion valve communication part 214*b*.

Thereafter, the refrigerant flowing back to the subcooler 233 through a third subcooler communication part 213*c* is cooled and then returns to the second housing 210 through a fourth subcooler communication part 213*d*.

The refrigerant flowing in this way is selectively transmitted to the accumulator 60 through the second solenoid valve 235 and thus reduces the proportion of the liquid refrigerant existing in the accumulator 60.

In addition, the refrigerant flowing back to the second housing 210 through the fourth subcooler communication part 213*d* is selectively transmitted to the compressor 10 through the third solenoid valve 236, thereby cooling the overheated compressor 10 or warming the frozen compressor 10.

The sub-expansion valve 234 expands only a small amount of refrigerant before the refrigerant passing through the subcooler 233 is discharged toward the indoor heat exchanger 50 through the second inflow and outflow part 212, and discharges the refrigerant toward the second and third solenoid valves 235, 236.

One end of the sub-expansion valve 234 is fixedly connected to the first sub-expansion valve communication part 214*a*. However, the other end of the sub-expansion valve 234 has a shape and a length such that it cannot be directly connected to the second sub-expansion valve communication part 214*b*, and thus an additional pipe is used to connect the short part. Therefore, one end of the additional pipe is fixedly connected to the second sub-expansion valve communication part 214*b* and the other end is fixedly connected to the sub-expansion valve 234.

The second solenoid valve 235 selectively transmits the refrigerant flowing in through the fourth subcooler communication part 213*d* to the accumulator 60 as described above. The second solenoid valve 235 is fixedly connected to the second solenoid valve communication part 215.

The third solenoid valve 236 selectively transmits the refrigerant flowing in through the fourth subcooler communication part 213*d* to the compressor 10 as described above. The third solenoid valve 236 is fixedly connected to the third solenoid valve communication part 216.

The third solenoid valve 236 and the third solenoid valve communication part 216 may be provided as many as the number of compressors 10. Therefore, when a plurality of compressors 10 are provided, the third solenoid valve 236 and the third solenoid valve communication part 216 are also provided in plural number. Since the two compressors 10 are provided in the present exemplary embodiment, two third solenoid valves 236 and two third solenoid valve communication parts 216 are provided.

The external expansion valve 237 expands the refrigerant flowing from the indoor heat exchanger 50 during the heating operation. Specifically, the refrigerant flowing from the indoor heat exchanger 50 flows into the second housing 210 through the first subcooler communication part 213*a*. Thereafter, the refrigerant does not move through the path where the refrigerant has flowed during the cooling operation due to the presence of the second check valve 231, and flows into the external expansion valve 237 through a first external expansion valve communication part 217*a*, and the refrigerant passing through the external expansion valve 237 returns to the second housing 210 through the second external expansion valve communication part 217*b*.

One end of the external expansion valve 237 is fixedly connected to the first external expansion valve communication part 217*a* protruding to the outside of the second housing. However, the other end of the external expansion valve 237 has a shape and a length such that it cannot be directly connected to the second external expansion valve communication part 217*b*, and thus an additional pipe is used to connect the short part. Therefore, one end of the additional pipe is fixedly connected to the second external expansion valve communication part 217*b* and the other end is fixedly connected to the external expansion valve 237.

On the other hand, an internal expansion valve (not shown) for expanding the refrigerant during the cooling operation is provided in the indoor unit, and thus a detailed description thereof is omitted.

Since the second check valve 231, the filter 232, the subcooler 233, the sub-expansion valve 234, the second solenoid valve 235, and the third solenoid valve 236, and the external expansion valve 237 described above are well known, a detailed description thereof is omitted.

Figure 7:
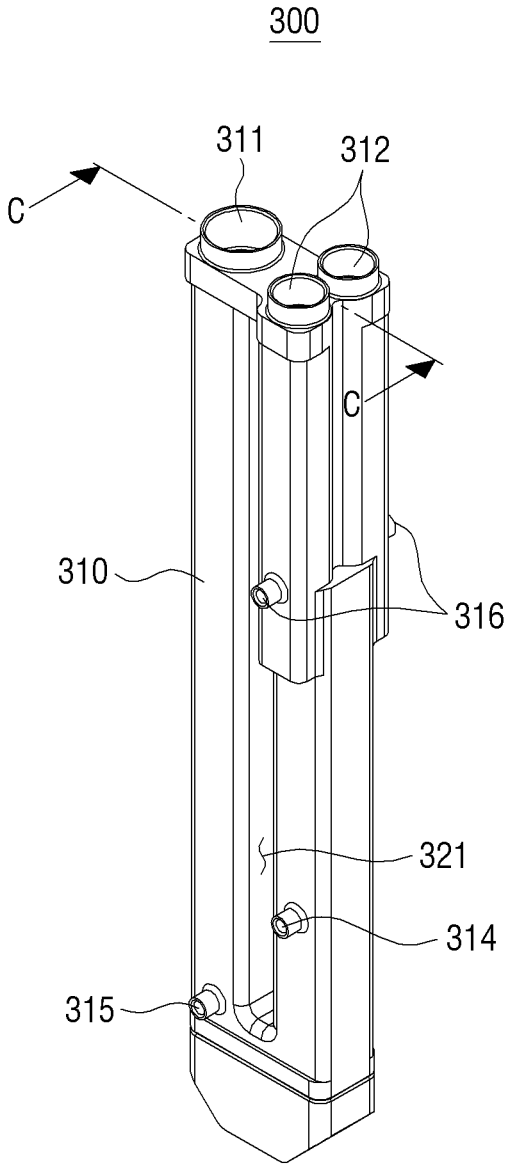
FIG. 7 is a perspective view showing a third block of FIG. 1.
Figure 8:
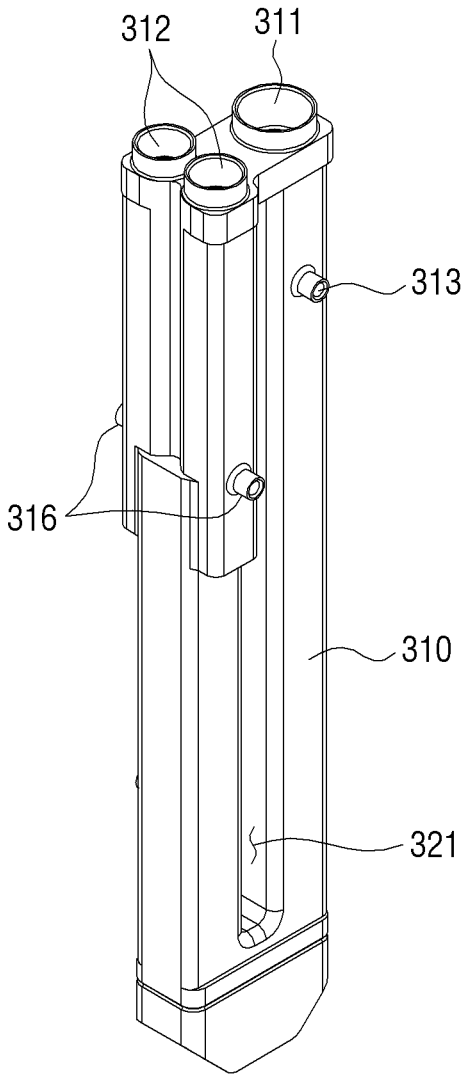
FIG. 8 is a perspective view showing the third block of FIG. 7 as viewed from the opposite direction.

Referring to FIGS. 7 and 8, a third block 300 is disposed on the channel of the refrigerant between the accumulator 60 and the compressor 10, and includes a third housing 310 and third control parts 330.

The third housing 310 includes a second inflow part 311, a second discharge part 312, third communication parts 313, 314, and connection parts 315, 316.

The second inflow part 311 is a part through which the refrigerant discharged from the accumulator 60 flows in, and the second discharge part 312 is a part through which the flowing refrigerant is discharged toward the compressor 10. In this case, since the compressor 10 may be provided in plural number, the second discharge part 312 may be provided in plural number as many as the number of compressor 10. Since the two compressors 10 are provided in the present exemplary embodiment, two second discharge parts 312 may be provided.

The third control parts 330, which are disposed on the channel of the refrigerant between the accumulator 60 and the compressor 10, are connected and fixed to the third communication parts 313, 314, and the third communication parts 313, 314 include a low-pressure sensor communication part 313 and a fourth solenoid valve communication part 314. The third communication parts 313, 314 will be explained along with the third control parts 330 connected thereto.

The connection parts 315, 316 include a first capillary tube connection part 315 to which a first capillary tube 333 communicating with the first block is connected and fixed, and a second capillary tube connection part 316 to which a second capillary tube 334 communicating with the oil separator 20 is connected and fixed.

In this case, when a plurality of compressors 10 are provided, the oil separator 20 is provided as many as the number of compressors 10. Therefore, the second capillary tube connection part 316 is also provided in plural number as many as the number of oil separators 20. Since the two oil separators 20 are provided in the present exemplary embodiment, two second capillary tube connection parts 316 are provided.

The second inflow part 311 and the second discharge part 312 may be connected to a pipe where the refrigerant flows by welding, and the third communication parts 313, 314 may be connected with the third control parts 330 by welding. The connection parts 315, 316 may be connected with the first and second capillary tubes 333, 334 by welding. The third block 300 moves in one body by the welding.

However, in order to prevent a damage and deformation from occurring on parts of the third housing 310 except for the part requiring the welding as in the case of the first and second blocks, the second inflow part 311, the second discharge part 312, the third communication parts 313, 314, and the connection parts 315, 316 protrude to the outside of the third housing 310. In addition, an unnecessary part 321 except for the pipe where the refrigerant flows may be removed from the third housing 310 when the third housing 310 is manufactured.

The third control parts 330 include a low-pressure sensor 331 and a fourth solenoid valve 332.

The low-pressure sensor 331 measures the pressure of the low-pressure refrigerant flowing from the accumulator 60 and controls the driving of the compressor 10. The low-pressure sensor 331 is fixedly connected to the low-pressure sensor communication part 313.

The fourth solenoid valve 332 selectively discharges the oil, which has been separated from the refrigerant and stored in the lower portion of the accumulator 60, toward the compressor 10. The fourth solenoid valve 332 is fixedly connected to the fourth solenoid valve communication part 314.

Since the low-pressure sensor 331 and the fourth solenoid valve 332 described above are well known, a detailed description thereof is omitted.

As described above, when the first check valve 131 is fixedly disposed in the first housing 110, and the high-pressure switch 132, the high-pressure sensor 133, and the first solenoid valve 134 are fixedly connected to the communication parts 113-115 of the first housing 110, the modularized first block 100 vibrates in one body.

In addition, when the second check valve 231 and the filter 232 are fixedly disposed in the second housing 210, and the subcooler 233, the sub-expansion valve 234, the second solenoid valve 235, the third solenoid valve 236, and the external expansion valve 237 are fixedly connected to the communication parts 213*a*-217*b* of the second housing 210, the modularized second block 200 vibrates in one body.

In addition, when the low-pressure sensor 331 and the fourth solenoid valve 332 are fixedly connected to the communication parts 313, 314 of the third housing 310, the modularized third block 300 vibrates in one body.

Accordingly, the control parts 130, 230, and 330, which individually vibrate by receiving the vibration of the compressor 10, are modularized respectively, so that the number of secondary vibration sources (as described above, the compressor 10 is a primary vibration source) can be noticeably reduced and thus the vibration of the entire outdoor unit can be reduced. In addition, a resonance phenomenon and breakage of a pipe caused by the parts having their respective natural frequencies can be prevented. Also, pipes for connecting the parts can be omitted and thus an inner space of the indoor unit can be guaranteed.

In addition, although the parts are modularized by dividing the air conditioner into the three blocks in the present exemplary embodiment, the parts may be modularized by dividing the air conditioner into two or less blocks or four or more blocks. In the present exemplary embodiment, considering the pressure and temperature of the refrigerant passing through each part and each pipe, the first block 100 is configured to allow the high-pressure and high-temperature refrigerant, the second block 200 is configured to allow the high-pressure and room-temperature refrigerant, and the third block 300 is configured to allow the low-pressure and low-temperature refrigerant. Therefore, the maximum number of parts are modularized in the present exemplary embodiment.

In addition, when a plurality of compressors 10 are provided, the oil separator 20 is provided in plural number. In this case, since the plurality of oil separators 20 and the accumulator 60 are containers of a large volume, the oil separators 20 and the accumulator 60 may suffer from a heavier vibration. Therefore, the oil separators 20 and the accumulator 60 may be fixed to each other.

Figure 9:
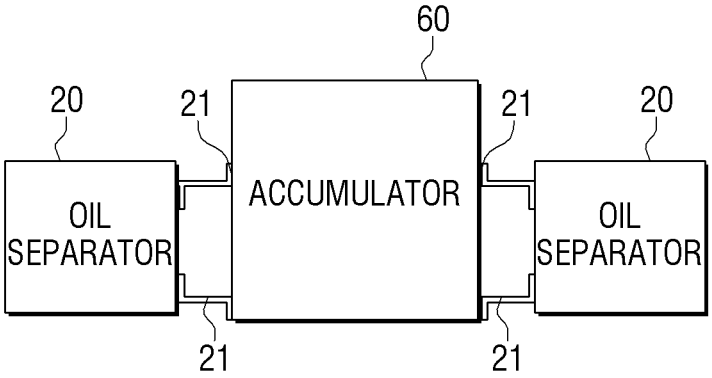
FIG. 9 is a front view showing a plurality of oil separators and an accumulator of FIG. 1 which are fixed to each other by means of a bracket.

Accordingly, referring to FIGS. 1 and 9, in the air conditioner 1 according to an exemplary embodiment, the plurality of oil separators 20 and the accumulator 60, which are of a container type, are fixed to each other. Accordingly, the plurality of oil separators 20 and the accumulator 60 vibrate in one body. Accordingly, the pipe connecting the plurality of oil separators 20 and the accumulator 60 can be prevented from being broken by a resonance phenomenon which occurs when the plurality of oil separators 20 and the accumulator 60 have the same natural frequency. In addition, the pipe is not required to be elongated and configured complexly in order to prevent breakage of the pipe caused by the resonance phenomenon. Accordingly, a larger inner space of the indoor unit can be guaranteed.

However, in this case, since the plurality of oil separators 20 are in a high-temperature state and the accumulator 60 is in a low-temperature state, there may be a problem in mutual heat transmission between the oil separators 20 and the accumulator 60. Therefore, referring to FIG. 9, a bracket 21 having a thin thickness may be used to fix the plurality of oil separators 20 and the accumulator 60 to each other. In this case, the plurality of oil separators 20 and the accumulator 60 are coupled to each other at a distance from each other and thus the problem of the mutual heat transmission can be solved.

In addition, in order to prevent the heat transmission problem between the plurality of oil separators 20 and the accumulator 60 more efficiently, an insulator may be added between the plurality of oil separators 20 and the accumulator 60.

When the inner space of the indoor unit of the air conditioner 1 is guaranteed as described above, the whole size of the indoor unit can be reduced, and a compressor having a high capacity can be used in the guaranteed space, so that cooling and heating efficiency can be enhanced.

The foregoing exemplary embodiments and advantages are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. An air conditioner having a compressor, an oil separator, a four-way valve, an outdoor heat exchanger, an indoor heat exchanger, and an accumulator, and the air conditioner configured to cool or heat a room by circulating a refrigerant, the air conditioner comprising:

a first block which is disposed on a first channel of the refrigerant between the oil separator and the four-way valve, the first block being modular and having a plurality of first control parts configured to control the refrigerant as the refrigerant passes through the first channel; and a second block which is disposed on a second channel of the refrigerant between the outdoor heat exchanger and the indoor heat exchanger, the second block being modular and having a plurality of second control parts configured to control the refrigerant as the refrigerant passes through the second channel.

2. The air conditioner of claim 1, wherein the first block comprises a first housing having a part of the plurality of first control parts fixed outside the first housing, and other parts of the plurality of first control parts disposed inside the first housing.

3. The air conditioner of claim 2, wherein the first housing has a plurality of first communication parts protruding outside the first housing to communicate with the plurality of first control parts, and wherein a part of the plurality of first control parts is fixed to a part of the plurality of first communication parts by welding.

4. The air conditioner of claim 1, wherein the plurality of first control parts comprise at least one of a first check valve, a first solenoid valve, a high-pressure switch, and a high-pressure sensor.

5. The air conditioner of claim 1, wherein the second block comprises a second housing having a part of the plurality of second control parts fixed outside the second housing, and other parts of the plurality of second control parts disposed inside the second housing.

6. The air conditioner of claim 5, wherein the second housing has a plurality of second communication parts protruding outside the second housing to communicate with the plurality of second control parts, and wherein a part of the plurality of second control parts is fixed to a part of the plurality of second communication parts by welding.

7. The air conditioner of claim 1, wherein the plurality of second control parts comprise at least one of a second check valve, a filter, a subcooler, a sub-expansion valve, a second solenoid valve, a third solenoid valve, and an outdoor expansion valve.

8. The air conditioner of claim 1, further comprising:

a third block which is disposed on a third channel of the refrigerant between the accumulator and the compressor, the third block being modular and having a plurality of third control parts.

9. The air conditioner of claim 8, wherein the third block comprises a third housing having the plurality of third control parts fixed outside the third housing.

10. The air conditioner of claim 9, wherein the third housing has a plurality of third communication parts protruding outside the third housing to communicate with the plurality of third control parts, and wherein the plurality of third control parts are fixed to the plurality of third communication parts by welding.

11. The air conditioner of claim 8, wherein the plurality of third control parts comprise at least one of a low-pressure sensor and a fourth solenoid valve.

12. The air conditioner of claim 1, wherein plural compressors including the compressor are provided, wherein plural oil separators including the oil separator are provided to correspond with the plural compressors, and wherein the oil separators and the accumulator are fixed to each other and move in one body.

13. The air conditioner of claim 12, wherein the oil separator is fixed to the accumulator by a bracket to be at a distance from the accumulator.

14. The air conditioner of claim 1, wherein a portion of the refrigerant which passes through the first bock has a higher temperature than that of another portion of the refrigerant which passes through the second block.

15. The air conditioner of claim 8, wherein a portion of the refrigerant which passes through the first block has a higher temperature than that of another portion of the refrigerant which passes through the second block, and the other portion of the refrigerant which passes through the second block has a higher temperature than that of a respective portion of the refrigerant which passes through the third block.

* * * * *